US006189431B1

(12) United States Patent
Danner et al.

(10) Patent No.: US 6,189,431 B1
(45) Date of Patent: Feb. 20, 2001

(54) SMALL CALIBER GUN BARREL

(75) Inventors: Dale R. Danner; Marlin R. Jiranek, II, both of Elizabethtown, KY (US)

(73) Assignee: Remington Arms Company, Inc., Madison, NC (US)

( * ) Notice: Under 35 U.S.C. 154(b), the term of this patent shall be extended for 0 days.

(21) Appl. No.: 09/013,592

(22) Filed: Jan. 26, 1998

(51) Int. Cl.[7] ..... F41A 21/20
(52) U.S. Cl. ..... 89/16; 89/15; 42/76.02; 29/1.11
(58) Field of Search ..... 89/14.05, 15, 16; 42/76.02; 29/1.11

(56) References Cited

U.S. PATENT DOCUMENTS

| | | | | |
|---|---|---|---|---|
| 496,637 | * | 5/1893 | Brown | 89/16 |
| 2,847,786 | * | 8/1958 | Hartley et al. | 42/76.01 |
| 2,935,913 | * | 5/1960 | Wilson | 89/16 |
| 3,118,243 | * | 1/1964 | Manshel | 42/76.02 |
| 3,517,585 | * | 6/1970 | Slade | 89/16 |
| 4,685,236 | * | 8/1987 | May | 89/15 |
| 5,054,224 | * | 10/1991 | Friar et al. | 42/76.02 |
| 5,600,912 | * | 2/1997 | Smith | 89/16 |
| 5,657,568 | * | 8/1997 | Christensen | 42/76.01 |
| 5,692,334 | * | 12/1997 | Christensen | 42/76.02 |
| 5,804,756 | * | 9/1998 | Christensen | 89/15 |

FOREIGN PATENT DOCUMENTS

| | | | | |
|---|---|---|---|---|
| 1167676 | * | 5/1984 | (CA) | 89/16 |

* cited by examiner

*Primary Examiner*—Stephen M. Johnson
(74) *Attorney, Agent, or Firm*—Huntley & Associates

(57) ABSTRACT

A composite barrel for a firearm comprising a substantially metallic liner and fiber reinforced resin, in which the fiber reinforced resin is under compression.

32 Claims, 1 Drawing Sheet

SMALL CALIBER GUN BARREL

BACKGROUND OF THE INVENTION

This invention relates generally to firearms. More particularly, this invention relates to small caliber firearms having reduced weight and increased portability.

In the manufacture of firearms, effort has long been directed to the production of lightweight products. This need has been partially met by previous firearms having a lighter barrel, a lighter stock, or other components. However, there remains a particular need for a firearm having a barrel of reduced weight, in which the reduction of barrel weight does not negatively affect the rigidity of the barrel or the accuracy of the firearm.

SUMMARY OF THE INVENTION

The present invention provides a lightweight barrel for a small caliber firearm that resists torsion and retains the excellent performance characteristics of prior barrels. By small caliber is meant those arms of 50 caliber or less. The invention further provides a method for the manufacture of such barrels.

Specifically, the present invention provides a gun barrel comprising:

(a) a thermally expandable tubular liner having an outer surface, a breech end and a muzzle end defining a longitudinal axis, and an external retaining flange at each end of the liner, each flange extending from the outer surface of the liner at least about 15% of the wall thickness of the liner; and (b) at least one layer on the outer surface of the liner, each layer comprising cured resin and reinforcing fiber, wherein the fiber in the at least one layer is disposed in a substantially uniform angle of greater than 0° and less than 90° with respect to the longitudinal axis of the liner and the at least one layer is longitudinally compressed at a pressure of at least about 5 ksi.

The present invention further provides a process for the production of gun barrels comprising:

(a) forming a thermally expandable tubular liner having an outer surface, a breech end and a muzzle end defining a longitudinal axis, and an external retaining flange at each end of the liner, each flange extending from the outer surface of the liner at least about 15% of the wall thickness of the liner;

(b) forming at least one layer on the outer surface of the liner, each layer comprising curable resin and reinforcing fiber, wherein the fiber in the at least one layer is disposed in a substantially uniform angle of greater than 0° and less than 90° with respect to the longitudinal axis of the liner;

(c) heating the fiber and resin wrapped liner to expand the liner;

(d) consolidating the fiber and resin about the liner to conform the fiber and resin to the liner;

(e) curing the resin; and (f) cooling the wrapped liner to contract the liner and place the cured fiber and resin in longitudinal compression of at least about 5 ksi between the breech and muzzle ends of the liner.

DETAILED DESCRIPTION OF THE INVENTION

The present invention is based on the discovery that a gun barrel having excellent performance characteristics and light weight can be prepared by a combination of a metal liner and one or more fiber-reinforced layers on the liner, and longitudinal compression of the fiber-reinforced layers.

The tubular liners used in the present invention are prepared from heat expandable material. While a variety of such materials can be used, including metal ceramics, metal matrix composites, and metal-glass fiber composites, metal liners are preferred, and particularly those prepared from the steels customarily used in rifle barrel manufacture. The liners are characterized by an external retaining flange at each end of the liner, each flange extending from the outer surface of the liner at least about 15%, and preferably at least about 25%, of the wall thickness of the liner. These flanges, combined with the thermally expandable characteristics of the liner, are one means of imparting compression on the fiber-reinforced layers applied to the liner. The length of the liners will vary according to usual requirements for firearm manufacture, and are typically about from 20 to 26 inches in length. The wall thickness of the liner, however, is substantially less than normal barrels, and, by itself, insufficient to withstand firearm use.

Figure 1:
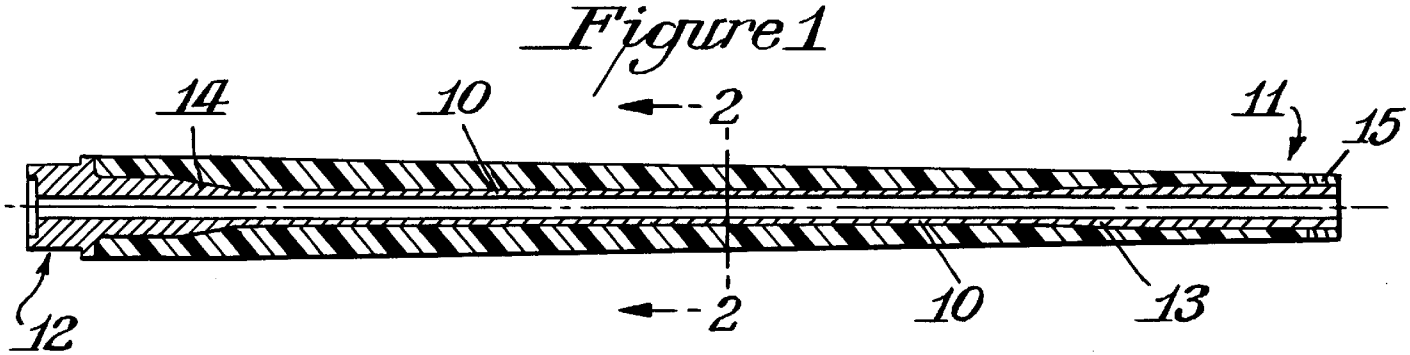
FIG. 1 is a side cross-sectional view of one embodiment of a barrel of the present invention.

With reference to FIG. 1, the barrel liner preferably has a center section 10 in which the wall of the liner is thinnest. Typically, if conventional steels are used, the thickness of the liner walls at this point will be about from 0.020 to 0.100 inch. The walls are somewhat thicker at the muzzle end 11 and the breech end 12, which respectively hold muzzle end retaining flange 13 and breech end flange 14. The barrel, as shown, further comprises protective end cap 15. While a variety of materials can be used for the end cap, metal is preferred. The end cap protects the end of the barrel from damage in use.

The barrel liner has applied thereto at least one layer on the outer surface thereof, each layer comprising cured resin and reinforcing fiber. A layer is defined by one or more fibers along the liner in a substantially parallel configuration, oriented either substantially parallel or substantially transverse to the longitudinal axis of the liner. In the construction of the present barrels, it is preferred that the fiber in at least one layer comprises a single tow. In fact, a single multifilament fiber, or tow, can be used for all layers of the barrel, and such a construction is preferred for structural integrity and ease of manufacture.

A wide variety of types and materials can used for the fiber in the layers applied to the liner. The fiber can, for example, be selected from the group consisting of monofilament and multiple filament, of which multiple filaments, or tows, are preferred. The fiber can be prepared from a variety of high tensile modulus materials, such as carbon, graphite, and polyaramide. Of these, graphite fiber is preferred for its performance characteristics and ready availability. In general, the material selected should have an axial tensile modulus of at least about $30\times10^6$ psi.

The configuration of the fiber can vary widely, and include, for example, monofilament or multiple filament. As noted above, multiple filaments are preferred, and can be selected from the group consisting of tow, strand and braid. Of these, graphite tow has been found to be particularly satisfactory. That graphite fiber commercially available as IM-7 graphite tow has been found to be particularly satisfactory.

The matrix resin used can be curable to its final state by either chemical or thermal techniques. However, thermally cured resins are preferred, since, in the preparation of the present barrels, the liner is heated to expand it before final cure. The resin can be selected from a wide variety of commercially available resins, including epoxies, bismaleimide (BMI) resins, cyanate esters and polycyanates. The resin should be selected to have a high performance temperature, and particularly those having an operating temperature of greater than 300° F. Epoxy resins are particularly preferred, of which those commercially available as Hexel resins or 977-2 epoxy resins have been found to be particularly satisfactory.

The fiber and resin can be applied separately or simultaneously. If applied simultaneously, a fiber impregnated with the resin can be conveniently used. In the application of the fiber, the layers should generally have the fiber aligned substantially parallel or substantially transverse to the longitudinal axis of the barrel liner. In general, the longitudinal reinforcing fibers provide stiffness, while the transverse, or "hoop" fibers impart burst strength. The number and order of the layers can accordingly be adjusted to achieve the desired performance characteristics. In the present constructions, at least four layers are preferably used, and, in this preferred embodiment, at least two longitudinal layers and at least two hoop layers are used. It is especially preferred to have at least ten layers of the fiber and resin. In that case, at least about 60%, and especially at least about 70%, of the layers are preferably hoop layers.

The thickness and order of the longitudinal and hoop layers can be adjusted to accommodate the specific materials used, but the two types of layers will typically alternate. To accommodate the depressed central portion of the liner, additional wrapping of those central areas permits the preparation of a finished product having a uniform exterior circumference. In addition to the layers in which the fiber is oriented in directions substantially parallel or transverse to the longitudinal axis, layers can be used in which the fiber is at a 45° angle. Such layers are typically used as the outermost layers, but can be inserted elsewhere in the construction, depending on the performance characteristics desired. These layers, when used on the exterior of the barrel, are primarily for decorative purposes. When used as an interior layer, these layers provide torsional stiffness to the finished barrel.

Figure 2:
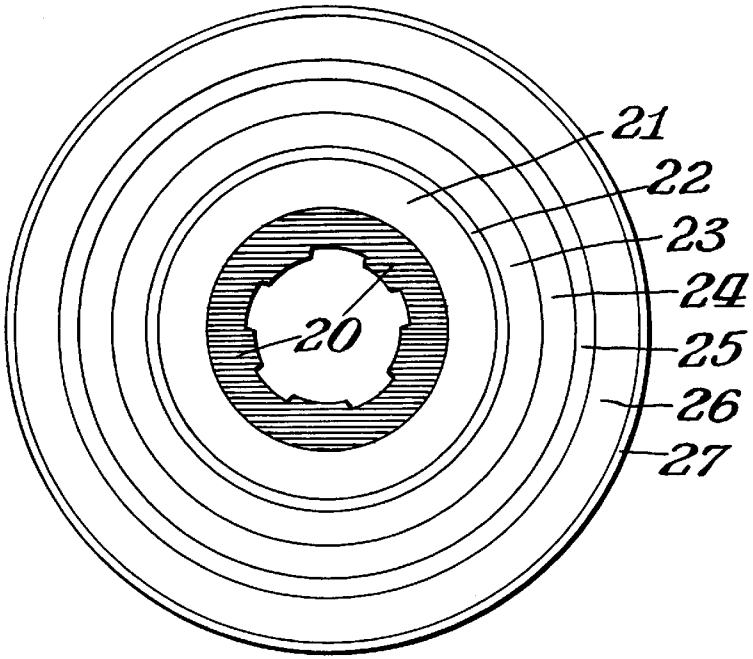
FIG. 2 is an enlarged transverse cross-sectional view of one embodiment of a barrel of the present invention, taken at section 2—2 of FIG. 1.

A representative construction is illustrated in FIG. 2, which is a transverse cross-sectional view of one embodiment of a barrel of the present invention, taken at section 2—2 of FIG. 1. In that Figure, liner 20 has seven layers applied thereto, respectively identified as layers 21 to 27. Layers 21, 23 and 25 have the fibers in a resin matrix oriented in a direction substantially transverse to the longitudinal axis of the barrel, while layers 22, 24 and 26 have the fibers oriented in a direction substantially parallel to the longitudinal axis of the barrel. In layer 27, the topmost layer, the fibers are at a substantially 45 degree angle with respect to the longitudinal axis.

In the application of the layers of fiber and resin to the liner, and to accommodate the expansion of a steel liner, it is preferred to first apply a thin layer of fiberglass on the outer surface of the liner.

The barrels of the present invention are prepared by first forming the thermally expandable tubular liner by conventional metal working techniques, and then applying the layers of curable resin and reinforcing fiber. The fiber and resin can be laid down, at the desired angle, by commercially available filament winding apparatus. Thereafter, the fiber and resin wrapped liner is heated to expand the liner, the structure treated to consolidate the fiber and resin about the liner to conform the fiber and resin to the liner and cure the resin. The time and temperature for curing the resin will depend on the specific fiber-resin system selected, and can be carried out according to the manufacturer's specifications. Depending on the number of layers and the materials selected, it may be desirable to partially cure one or more interior layers before application of outer layers. Typical curing temperatures for the preferred epoxy resins are about from 250 to 500° F. Temperatures of about 350° F. are typically used for these resins. Depending on the particular resin selected, elevated pressures can also be used in the curing operation.

The consolidation of the layers on the liner is preferably carried out by placing the wrapped liner in an environment having elevated pressure, for example, at least about 100 psi. The consolidation is preferably carried out while the wrapped liner is being heated for curing. The consolidation should be carried out for a sufficient period of time to fully cure the resin and reduce the void content of the at least one layer to less than about 5% by volume, and preferably to less than about 2% by volume. As will be recognized by those skilled in the art, the particular period will depend on a wide variety of factors, including the particular resin and fiber used, and the number of layers in the construction.

After consolidation to the desired void content and fully curing the resin, the structure is cooled to ambient temperatures. The cooling of the heat expandable liner, in conjunction with the retaining flanges on the liner, places the fiber and resin in longitudinal compression of at least about 5 ksi between the breech and muzzle ends of the liner. Generally, using metal liners, a compression of about from 5 to 25 ksi is realized.

The degree of compression can be readily calculated based on the thermal expansion characteristics of the materials used, the length of the barrel, and the quantity of fiber and resin applied to the liner. Briefly stated, as the composite shrinks, residual stresses are formed due to the effect of the cooling metal liners, compounded with the natural effects of the composite shrinking on itself. The barrel will continue to shrink until the residual tensile stresses in the liner are matched by the residual stresses in the composite layers applied to the liner. The equilibrium compression is applied to the composite layers by the flanges at the ends of the liner, and is substantially uniform along the length of the barrel, thus providing excellent long term wear characteristics.

The barrels of the present invention have been found to provide outstanding performance as rifle barrels, combined with light weight.

We claim:

1. A small caliber gun barrel comprising:

(a) a thermally expandable tubular liner having an outer surface, a breech end and a muzzle end defining a longitudinal axis, and an external retaining flange at each end of the liner, each said flange extending from the outer surface of the liner at least about 15% of the wall thickness of the liner; and (b) at least one layer on the outer surface of the liner, each layer comprising cured resin and reinforcing fiber, wherein the fiber in the at least one layer is disposed in a substantially uniform angle of greater than 0° and less than 90° with respect to the longitudinal axis of the liner and the at least one layer is longitudinally compressed at a pressure of at least about 5 ksi.

2. A gun barrel of claim 1 wherein at least one flange on the liner extends from the outer surface at least about 25% of the wall thickness of the liner.

3. A gun barrel of claim 2 wherein the fiber in at least about 60% of the layers is disposed in a direction substantially transverse to the longitudinal axis.

4. A gun barrel of claim 1 comprising at least four layers on the outer surface of the liner, wherein the fiber in at least two of the layers is disposed in a direction substantially parallel to the longitudinal axis of the liner and the fiber in at least two of the layers is disposed in a direction substantially transverse to the longitudinal axis.

5. A gun barrel of claim 4 comprising at least ten layers on the outer surface of the liner.

6. A gun barrel of claim 1 wherein the at least one layer is longitudinally compressed at a pressure of about from 5 to 25 ksi.

7. A gun barrel of claim 1 wherein the fiber is prepared from at least one selected from the group consisting of carbon, graphite, and polyaramide.

8. A gun barrel of claim 7 wherein the fiber is a multiple filament selected from the group consisting of tow, strand and braid.

9. A gun barrel of claim 1 wherein the fiber is selected from the group consisting of monofilament and multiple filament.

10. A gun barrel of claim 1 wherein the muzzle end of the liner further comprises a protective cap.

11. A gun barrel of claim 10 wherein the protective cap consists essentially of metal.

12. A gun barrel of claim 1 wherein the compression on the at least one layer is substantially uniform along the length of the barrel.

13. A gun barrel of claim 1 wherein the resin consists essentially of epoxy.

14. A gun barrel of claim 1 wherein the at least one layer comprises less than about 5% by volume of voids.

15. A gun barrel of claim 1 wherein the thermally expandable tubular liner consists essentially of metal.

16. A method of making a small caliber gun barrel comprising:

(a) forming a thermally expandable tubular liner having an outer surface, a breech end and a muzzle end defining a longitudinal axis, and an external retaining flange at each end of the liner, each flange extending from the outer surface of the liner at least about 15% of the wall thickness of the liner;

(b) forming at least one layer on the outer surface of the liner, each layer comprising cured resin and reinforcing fiber, wherein the fiber in the at least one layer is disposed in a substantially uniform angle of greater than 0° and less than 90° with respect to the longitudinal axis of the liner and the at least one layer is longitudinally compressed at a pressure of at least about 5 ksi.

(c) heating the fiber and resin wrapped liner to expand the liner;

(d) consolidating the fiber and resin about the liner to conform the fiber and resin to the liner;

(e) curing the resin; and (f) cooling the wrapped liner to contract the liner and place the cured fiber and resin in longitudinal compression of at least about 5 ksi between the breech and muzzle ends of the liner.

17. A method of claim 16 comprising forming at least four layers of curable resin and reinforcing fiber, wherein the fiber in at least two of the layers is disposed in a direction substantially parallel to the longitudinal axis of the liner and the fiber in at least two of the layers is disposed in a direction substantially transverse to the longitudinal axis.

18. A method of claim 17 wherein the fiber is at least one selected from the group consisting of carbon, graphite, and polyaramide.

19. A method of claim 17 wherein the curable resin consists essentially of epoxy.

20. A method of claim 17 wherein the fiber and resin are consolidated about the liner by placing the wrapped liner in an environment having elevated pressure.

21. A method of claim 16 comprising disposing the fiber in the layer immediately adjacent to the liner in a direction substantially transverse to the longitudinal axis of the liner.

22. A method of claim 16 comprising at least partially curing at least one of the layers applied to the metal liner prior to the application of a subsequent layer.

23. A method of claim 16 wherein the fiber and resin are applied to the liner simultaneously.

24. A method of claim 23 wherein the fiber is impregnated with resin.

25. A method of claim 13 wherein the fiber is selected from the group consisting of monofilament and multiple filament.

26. A method of claim 25 wherein the fiber is multiple filament selected from the group consisting of tow, strand and braid.

27. A method of claim 16 wherein the fiber and resin are consolidated while the wrapped liner is being heated.

28. A method of claim 16 wherein the wrapped liner is consolidated by placing the wrapped liner in an environment having an elevated pressure for a sufficient period of time to reduce the void content of the at least one layer to less than about 5% by volume.

29. A method of claim 28 wherein the wrapped liner is consolidated to reduce the void content of the at least one layer to less than about 2% by volume.

30. A method of claim 29 wherein the fiber is wrapped at varying angles between the transverse (90°) and longitudinal (0°) relative to the longitudinal axis of the liner.

31. A method of claim 16 comprising forming at least ten layers of the fiber and resin on the liner.

32. A method of claim 16 wherein the fiber in at least one layer comprises a single fiber.

* * * * *

UNITED STATES PATENT AND TRADEMARK OFFICE

CERTIFICATE OF CORRECTION

PATENT NO. : 6,189,431 B1
DATED : February 20, 2001
INVENTOR(S) : Danner, et al.

It is certified that error appears in the above-identified patent and that said Letters Patent is hereby corrected as shown below:

Column 6,
Line 34, change "13" to read -- 16 --.

Signed and Sealed this

Sixth Day of November, 2001

*Attest:*

Nicholas P. Godici

NICHOLAS P. GODICI
*Acting Director of the United States Patent and Trademark Office*

*Attesting Officer*

UNITED STATES PATENT AND TRADEMARK OFFICE

CERTIFICATE OF CORRECTION

PATENT NO. : 6,189,431 B1
APPLICATION NO. : 09/013592
DATED : February 20, 2001
INVENTOR(S) : Danner et al.

It is certified that error appears in the above-identified patent and that said Letters Patent is hereby corrected as shown below:

In the Claims:

Claim 16:

Column 5, line 52, please replace "cured" with --curable--

Column 5, line 58, please replace "." with --;--

Signed and Sealed this
Twenty-third Day of April, 2013

Teresa Stanek Rea
*Acting Director of the United States Patent and Trademark Office*